US009208760B2

(12) United States Patent
Drushal et al.

(10) Patent No.: US 9,208,760 B2
(45) Date of Patent: Dec. 8, 2015

(54) PERCUSSION INSTRUMENT WITH INTERIOR PORTING

(71) Applicant: Pitch Slap Percussion LLC, Boynton Beach, FL (US)

(72) Inventors: Charles Trevor Drushal, North Palm Beach, FL (US); Jeffrey C. Poppe, Lake Worth, FL (US)

(73) Assignee: Pitch Slap Percussion LLC, Boynton Beach, FL (US)

( * ) Notice: Subject to any disclaimer, the term of this patent is extended or adjusted under 35 U.S.C. 154(b) by 0 days.

(21) Appl. No.: 14/375,487

(22) PCT Filed: Jan. 30, 2013

(86) PCT No.: PCT/US2013/023814

§ 371 (c)(1),
(2) Date: Jul. 30, 2014

(87) PCT Pub. No.: WO2013/116317

PCT Pub. Date: Aug. 8, 2013

(65) Prior Publication Data

US 2014/0373699 A1 Dec. 25, 2014

Related U.S. Application Data

(60) Provisional application No. 61/592,087, filed on Jan. 30, 2012.

(51) Int. Cl.
*G10D 13/02* (2006.01)

(52) U.S. Cl.
CPC ..... *G10D 13/021* (2013.01); *G10D 13/02* (2013.01)

(58) Field of Classification Search
CPC ..... G10D 13/02; G10D 13/021
See application file for complete search history.

(56) References Cited

U.S. PATENT DOCUMENTS 627,766 A * 6/1899 Wilken ..... 84/414
D100,734 S * 8/1936 Lira ..... D17/22

(Continued)

FOREIGN PATENT DOCUMENTS

DE 202007000686 U1 * 6/2007
ES 1073806 2/2011

(Continued)

OTHER PUBLICATIONS

Mike playing a Dual-Chamber Cajon—outsidetheboxdrums.com, Dustin Gooding, uploaded Jul. 28, 2008, citation of video image and comments.*

(Continued)

*Primary Examiner* — Robert W Horn
(74) *Attorney, Agent, or Firm* — Fleit Gibbons Gutman Bongini & Bianco PL; Jon A. Gibbons

(57) ABSTRACT

Disclosed is a novel "cajon" or box percussion instrument. A cuboid or rectangular shaped percussion instrument has six sides. It usually consists of five (5) panels of equal thickness with at least one panel of a thinner more flexible sixth panel which vibrates when percussed. One or more chambers and interior porting system are included in improve tonal quality. One or more external port openings, usually rectangular in shape, are formed in the unit to permit sound to emanate. Different external port geometries including shapes and sizes are contemplated. Encompassed in a single unit, the chamber delivers distinct independent tones. In some models, an interior resonating baffle and reflective block have been introduced to direct sound waves and air flow out of the exterior port opening creating a greater larger frequency range and greater amplification. In one example multiple independent chambers and interior porting system are included to improve the tonal quality.

17 Claims, 8 Drawing Sheets

(56) References Cited

U.S. PATENT DOCUMENTS

| | | | | | |
|---|---|---|---|---|---|
| 2,858,724 | A | * | 11/1958 | Troppe | 84/411 R |
| 3,724,313 | A | * | 4/1973 | Frigo et al. | 84/452 P |
| 4,026,185 | A | * | 5/1977 | Migirian | 84/411 R |
| 4,173,917 | A | * | 11/1979 | Della-Porta | 84/419 |
| D258,134 | S | * | 2/1981 | Widener | D17/22 |
| 4,457,202 | A | * | 7/1984 | DeBarbrie | 84/411 R |
| D296,447 | S | * | 6/1988 | Jowitt | D17/22 |
| 5,385,075 | A | * | 1/1995 | Carnes et al. | 84/411 R |
| 7,161,078 | B2 | | 1/2007 | Becker-Ehmck | |
| 7,482,522 | B2 | * | 1/2009 | Wening | 84/415 |
| 7,485,790 | B2 | * | 2/2009 | Payerl | 84/411 R |
| 7,601,901 | B2 | * | 10/2009 | Payerl | 84/411 R |
| 7,692,083 | B2 | * | 4/2010 | Aspland | 84/415 |
| 8,115,088 | B2 | * | 2/2012 | Herrera | 84/411 R |
| 8,735,704 | B2 | * | 5/2014 | Buchner | 84/411 R |
| 8,829,321 | B2 | * | 9/2014 | Klein | 84/411 R |
| 8,835,733 | B2 | * | 9/2014 | Boulet | 84/411 R |
| 2008/0083317 | A1 | * | 4/2008 | Payerl | 84/411 R |
| 2010/0031802 | A1 | * | 2/2010 | Millender et al. | 84/411 R |
| 2012/0000342 | A1 | * | 1/2012 | Klein | 84/415 |
| 2012/0073420 | A1 | * | 3/2012 | Schmader | 84/415 |
| 2014/0041508 | A1 | * | 2/2014 | Trask | 84/415 |
| 2014/0373699 | A1 | * | 12/2014 | Drushal et al. | 84/411 R |

FOREIGN PATENT DOCUMENTS

| | | | |
|---|---|---|---|
| JP | 2011008040 | | 1/2011 |
| JP | 3184744 U | * | 7/2013 |
| WO | 2011033434 | | 3/2011 |

OTHER PUBLICATIONS

International Preliminary Report on Patentability dated Aug. 5, 2014 received for PCT Application No. PCT/US2013/023814.

* cited by examiner

PERCUSSION INSTRUMENT WITH INTERIOR PORTING

CROSS-REFERENCE TO RELATED APPLICATIONS

This application is based upon and claims priority from prior PCT Application Ser. No. PCT/US2013/023814, filed on Jan. 30, 2013, which is based upon and claims priority from provisional patent application No. 61/592,087, filed on Jan. 30, 2012, the entire disclosure of each application is hereby incorporated by reference herein in its entirety.

FIELD OF THE INVENTION

The present invention generally relates to percussion instruments and more specifically to percussion instruments with interior porting.

BACKGROUND OF THE INVENTION

A "cajon" is a box-shaped instrument originally from Peru. The cajon is typically played by slapping the front face (general thin plywood) with the hands. In Cuba, it is known as a Cuban box percussion instrument that was originally used to play Rumba Yambu and now incorporated into many other styles. The bass box percussion instrument is large enough to sit on and is played with the palm, fist and fingers.

SUMMARY OF THE INVENTION

Disclosed is a novel "cajon" or box percussion instrument. A cuboid or rectangular shaped percussion instrument has six sides. It usually consists of five (5) panels of equal thickness with at least one panel of a thinner more flexible sixth panel which vibrates when percussed. One or more chambers and interior porting system are included in improve tonal quality. One or more external port openings, usually rectangular in shape, are formed in the unit to permit sound to emanate. Different external port geometries including shapes and sizes are contemplated. Encompassed in a single unit, the chamber delivers distinct independent tones. In some models, an interior resonating baffle and reflective block have been introduced to direct sound waves and air flow out of the exterior port opening creating a greater larger frequency range and greater amplification. In one example multiple independent chambers and interior porting system are included to improve the tonal quality.

In one example, a novel box percussion instrument is described. The instrument includes a cuboid shaped box with at least six panels is described. Further, the instrument includes at least one horizontal rectangular partition and/or at least one vertical rectangular partition to define at least two or more chambers inside the cuboid shaped box, with each chamber of equal or varying volume.

In another example, a novel box percussion instrument is described. The instrument includes a cuboid shaped box with at least six panels defining an interior chamber. The at least six panels define a top panel, a bottom panel, a back panel, a front panel, a first side panel and a second side panel. The front panel defines an opening that provides fluid communication between air external to the cuboid shaped box and the interior chamber. Also includes is a bottom reflective wall with a first side edge in contact with the first side panel, a second side edge in contact with the second side panel, a top edge in contact with the back panel, and a bottom edge in contact with an interior top side of the bottom panel.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention, in which.

DETAILED DESCRIPTION

Figure 1:
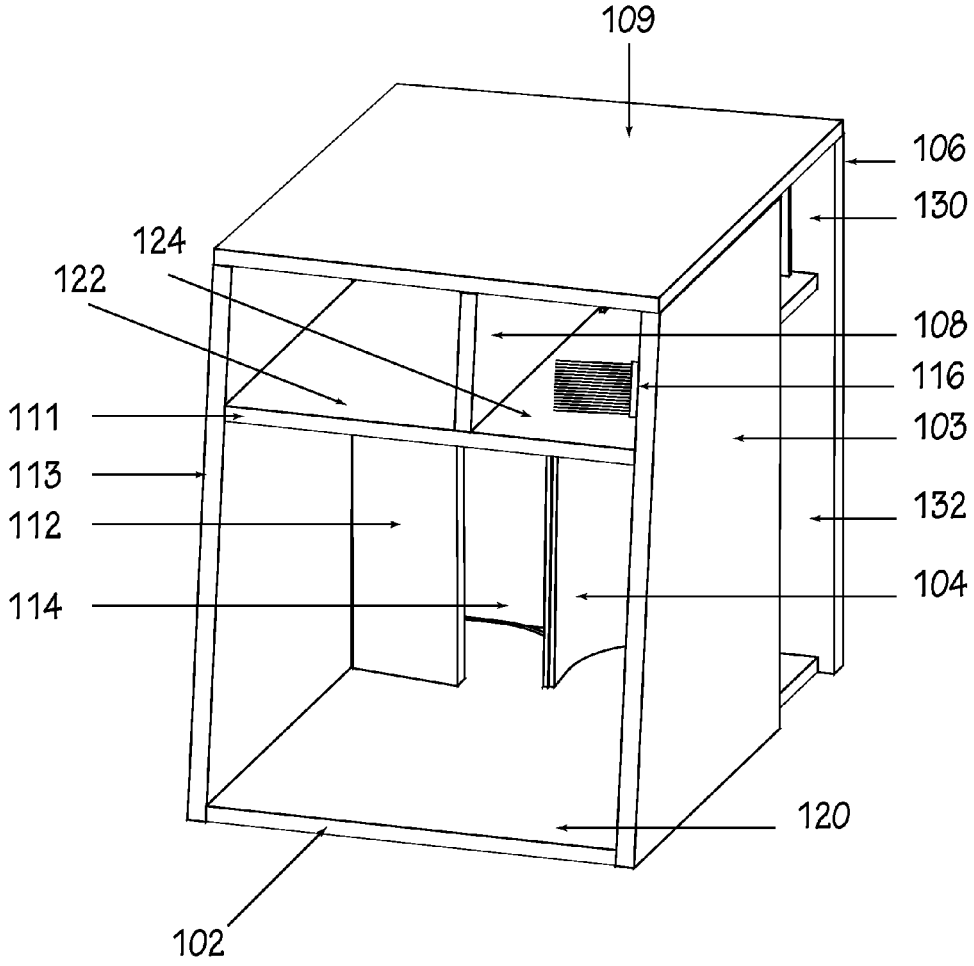
FIG. 1 is a front perspective view of an embodiment of percussion instrument called 3WAY with a front panel removed.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one as or more than one. The term plurality, as used herein, is defined as two as or more than two. Plural and singular terms are the same unless expressly stated otherwise. The term another, as used herein, is defined as at least a second or more. The terms including and/or having, as used herein, are defined as comprising (i.e., open language). The term coupled, as used herein, is defined as connected, although not necessarily directly, and not necessarily mechanically.

The term "attached" or "joined" means to mechanically couple using any fastener including but not limited to glue, screws, nails, wood joints, or a combination thereof. The term "panel" is used to mean a separate and distinct part of surface. In one example a panel is a thin board made out of wood, plastic, metal, composite, or a combination of organic and inorganic materials. Likewise, terms "scoop" and "rectangular partition" and "reflective block" and "baffle" and "return" is a panel made out of wood, plastic, metal, composite, or a combination of organic and inorganic materials that are used to direct sound waves.

Disclosed is an improved "cajon" or box percussion instrument. Typically, a cajon are cube or rectangular in shape wooden boxes that are used as percussion instruments. The six (6) sided percussion instrument usually consists of five (5) panels of equal thickness with a thinner more flexible sixth panel which vibrates when percussed. An external port, usually circular in shape is formed in a side opposite to the vibrating panel which allows the sound to emanate from the percussion instrument.

More specifically, the present invention provides a rectangular shaped percussion instrument. Generally, the percussion instrument has six sides. It usually consists of five (5) panels of equal thickness with at least one panel of a thinner more flexible sixth panel which vibrates when percussed. One or more chambers and interior porting system are included in improve tonal quality. One or more external port openings, usually rectangular in shape, are formed in the unit for sound to emanate. Different external port geometries including shapes and sizes are contemplated. Encompassed in a single unit, the chamber(s) deliver distinct independent tones. In some models, an interior resonating baffle and reflective block have been introduced to direct sound waves and air flow out of the exterior port opening creating a greater larger frequency range and greater amplification. The improvement in amplification was measured to be an average of 70 db.

Four examples of the improved cajon are now described. For convenience, and without any limitation, these four examples are referred to as "3WAY", "THUNDER", "LAP", and "TABLE".

3WAY

FIG. 1 is a front perspective view of an embodiment of percussion instrument called 3WAY with a front panel removed. The drawing depicts the invention housed within a percussive box instrument or cajon. Note the front panel (115 shown in FIG. 2) is removed to shown the inner cambers and ports.

Figure 2:
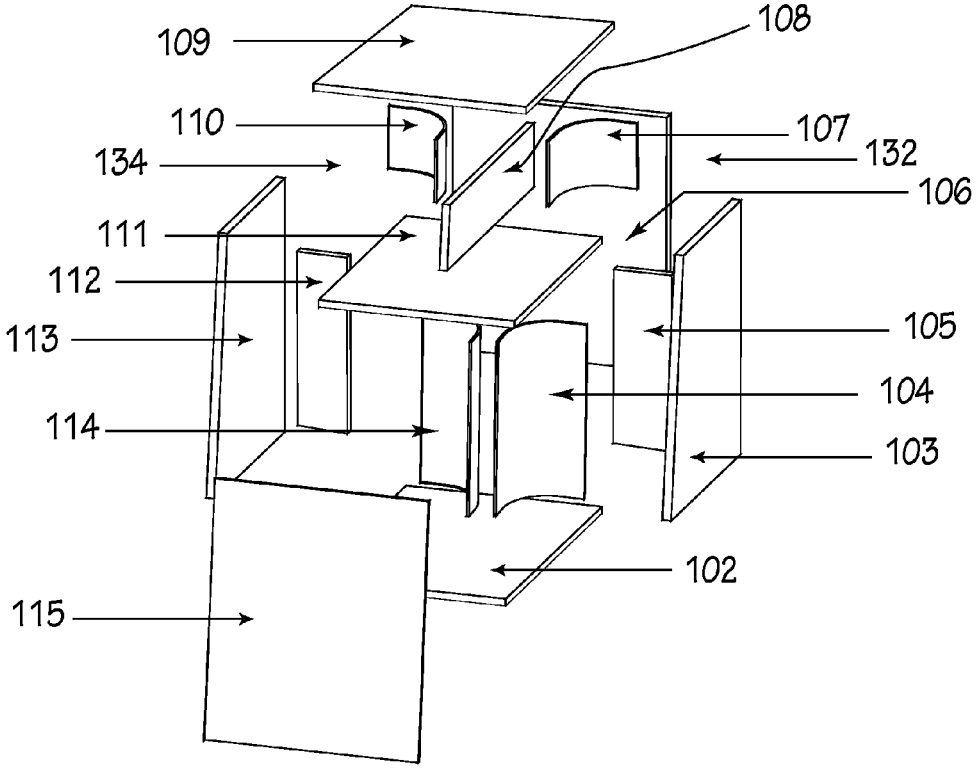
FIG. 2 is front explosion view of the embodiment of FIG. 1 for 3WAY.

A front explosion view of the embodiment of FIG. 1 for 3WAY embodiment is shown in FIG. 2. The percussion instrument includes a front playing head 115, a back panel 106, a top panel 109, a bottom panel 102, and two side panels 103 and 113. The top panel 109 allows for the player to be seated on the percussion instrument in order to easily percuss the front playing head. The side panels 103, 113 are attached to the bottom panel 102. The back panel 106 is attached to the bottom panel 102 creating the rectangular port opening 130. At least two internal port returns 105 and 112 are then attached to each of the side panels 103 and 113, which creates compression of sound waves and air pressure inside the bottom chamber when the playing surface is struck. At least two scoops 104 and 114 are attached to the center of the back panel 106, to smoothly direct airflow out of the two bottom port openings on either side 132 and 134 (not shown). The horizontal rectangular partition 111 separating the bottom chamber 120 from the top two chambers 122, 124 is attached onto the back panel 106 and the side panels 103, 113. A vertical rectangular partition 108 is attached onto the top of the horizontal partition 111, creating the top two chambers. In this example two scoops 107, 110 are attached to the back panel 106 and the vertical partition 108 to smoothly channel sound waves and air flow out of each of the top port openings. The invention has three separate chambers, 120, 122, 124, which allow the drum to have a very distinctive independent high to low range of sound to be emitted when the front facing panel 115 is percussed. An optional set of snare wires 116 are screwed to the side of the smallest chamber and positioned against the underside of the playing head 115. The top 109 is attached into place followed by the playing head 115.

THUNDER

Figure 3:
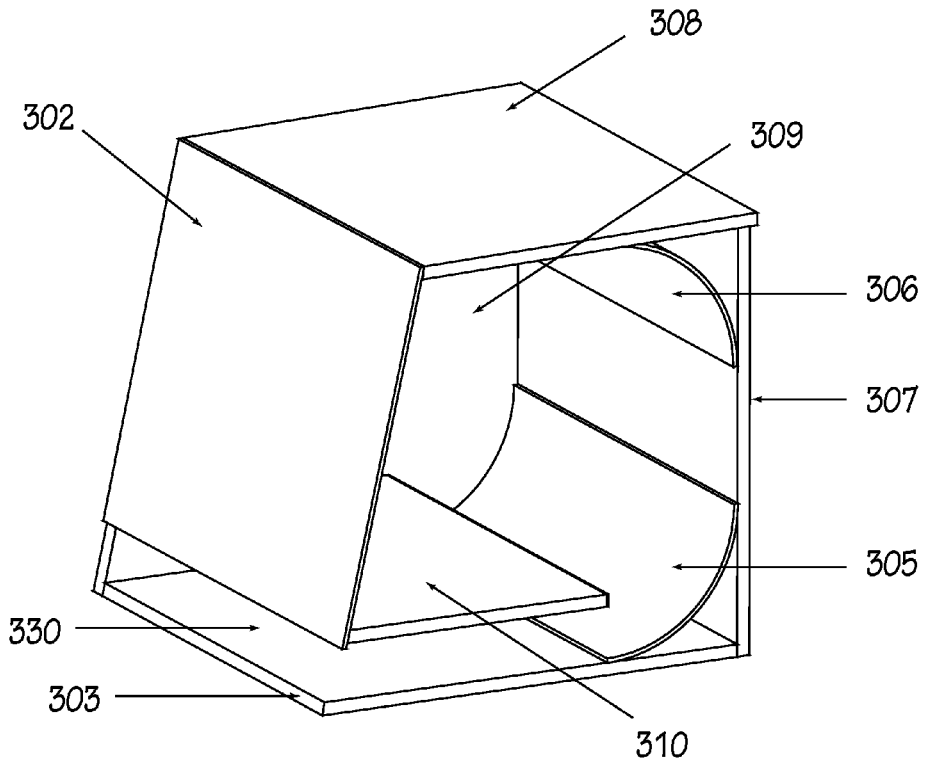
FIG. 3 is side perspective view of an embodiment of percussion instrument called THUNDER with a side panel removed.
Figure 4:
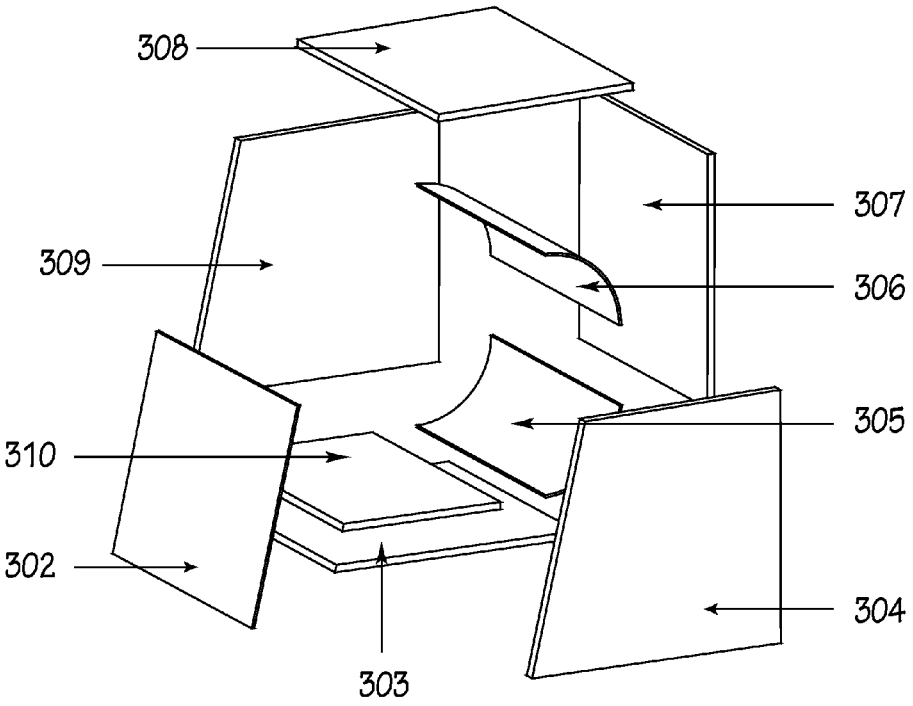
FIG. 4 is side explosion view of the embodiment of FIG. 3 for THUNDER.

FIG. 3 is side perspective view of an embodiment of percussion instrument called THUNDER with a side panel removed (304 of FIG. 4). FIG. 4 is side explosion view of the embodiment of FIG. 3 for THUNDER.

The cube or cuboid includes a front playing panel or head 302, back panel 307, top panel 308, bottom panel 303 and two side panels 304, 309. The top panel 308 allows for the player to be seated on the percussion instrument in order to easily percuss the front playing head 302. Within the cube are two curved wooden scoops or curved reflective walls 305, 306. The first scoop 305 is attached to the lower position via the back panel 307 and bottom panel 303. The second scoop 306 is attached to the upper position via the back panel 307 and top panel 308. A partition 310 is attached to the two side panels 304, 309 and front playing head 302. The inclusion on the curved pieces 305, 306 and return 310 compresses sound waves and air pressure inside the chamber. When the front panel 310 is percussed the sound waves are then smoothly direct out of the bottom front port opening 330.

LAP

Figure 5:
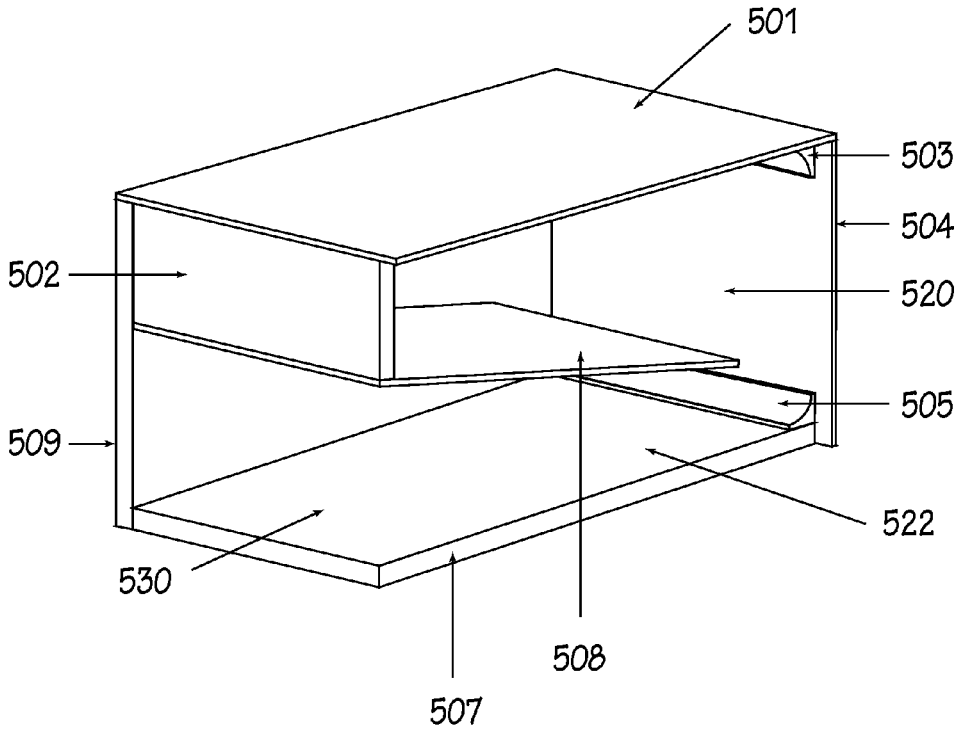
FIG. 5 is perspective view of an embodiment of percussion instrument called LAP with a side panel removed.
Figure 6:
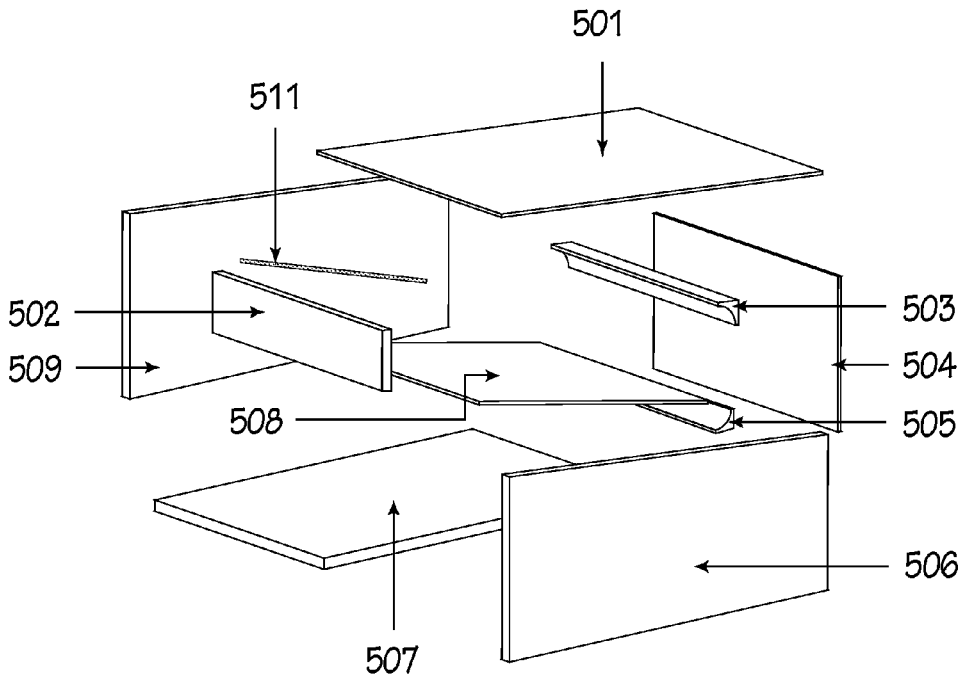
FIG. 6 is side explosion view of the embodiment of FIG. 5 for LAP.

FIG. 5 is perspective view of an embodiment of percussion instrument called LAP with a front panel 506 removed and FIG. 6 is side explosion view of the embodiment of FIG. 5 for LAP.

The cube is includes a side panel 502, a bottom panel 507, front panel 506, a top panel or playing head 501 and a side playing panel or side playing head 504. The assembly starts with joining the back panel 509 and the bottom panel 507. The resonating baffle 508 is assembled and attached to the back panel 509 and side channel 511 creating a split chamber 520 and 522. The reflective block 505 is attached to the side playing head 504 and bottom panel 507. With the introduction of the resonating baffle 508 percussion of the top playing head 502 that creates a compression of sound waves and directs them towards the reflective block 505, which then redirects the sound waves causing them to travel out of the exterior port opening 530. At the same time due to the compression of sound waves the resonating baffle 508 vibrates creating a separate set of sound waves that also travel out of the exterior port opening 530.

The side panel 502 framing the external port opening 530 is attached to the back panel 509. The front panel 506 is secured to the side 502 and bottom 507 panels, resonating baffle 508 and reflective block 505. A reflective block 503 is attached to the side playing head 504 to support the multiple playing surfaces 501, 504 which are attached to the side panel 502, the front panel 506, the back panel 509 and side panel 504. The two playing heads 501, 504 either of which the player may be percussed to create sound waves.

TABLE

Figure 7:
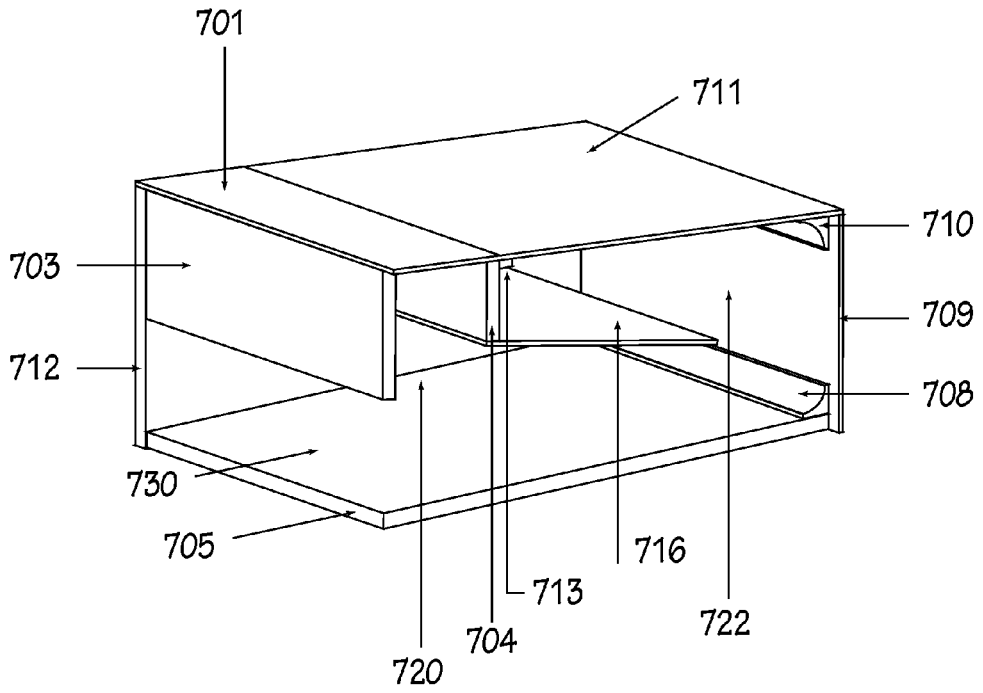
FIG. 7 is perspective view of an embodiment of percussion instrument called TABLE with a side panel removed.
Figure 8:
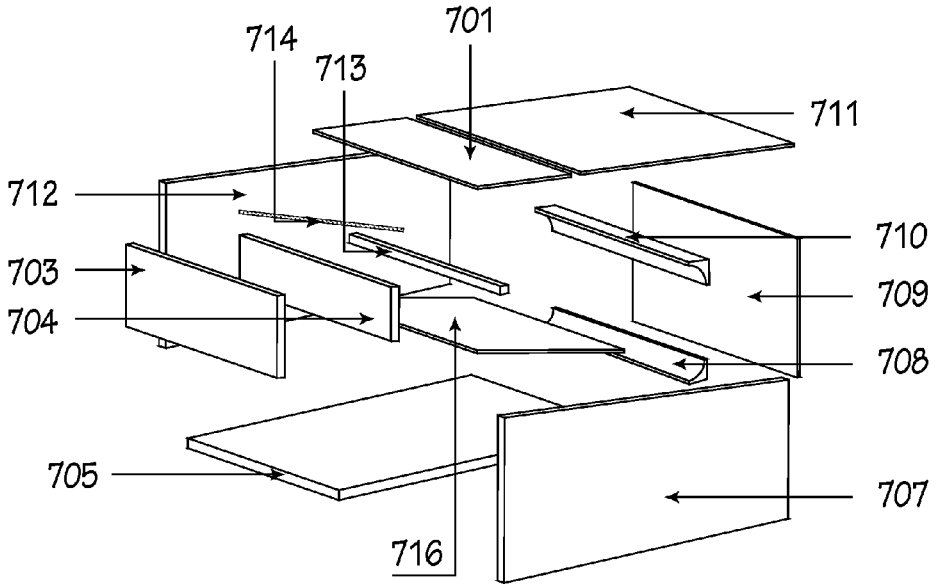
FIG. 8 is side explosion view of the embodiment of FIG. 7 for TABLE.

FIG. 7 is perspective view of an embodiment of percussion instrument called TABLE with a side panel 707 removed and FIG. 8 is side explosion view of the embodiment of FIG. 7 for TABLE.

The cube includes side panel 703, bottom panel 705, back panel 712 and front panel 707, two top separate playing surfaces or top playing heads 701, and 711 and a side playing head 709.

The assembly starts with joining the back panel 712 and bottom panel 705 together. The partition 704 and resonating baffle 716 are assembled and attached to the back panel 712 and side channel 714 creating two separate top chambers 720 and 722. Playing head 701 forms a side on chamber 720 and playing head 711 forms a side of chamber 722. The reflective block 708 is attached to the back panel 712 and bottom panel 705. With the introduction of the partition 704 and resonating baffle 716, percussion of the large top playing head 711 creates a compression of sound waves and directs them towards the reflective block 708, which then redirects the sound waves causing them to travel out of the exterior port opening 730. At the same time due to the compression of sound waves the resonating baffle 716 vibrates creating a separate set of sound waves that also travel out of the exterior port opening 730.

The abbreviated side panel 703 framing the external port opening is attached to the back panel 712. The front panel 707 is secured to the side panel 703 and bottom panel 705, partition 704, resonating baffle 716 and reflective block 708. A reflective block 710, and a support piece 713 are then attached to the partition 704 and the side playing head 709 to support the multiple playing surfaces 709, 711, 701. Two playing heads 711, 701 are attached to the top and one is attached to the side 709 any of which the player may percussed to create sound waves. The resonating baffle 716 as shown has a front edge, a back edge, a first side edge and a second side edge, the resonating baffle 716 placed with the front edge in contact with the bottom edge of the rectangular partition and the first side edge in contact with the side panel 712 and the second side edge in contact with the side panel 707, and placed at a height above a top of the opening 730 defined by the side panel 703 and the back edge place at a height lower than the front edge.

Non-Limiting Examples

The product's specs could be applied to any other derivations of a box percussion instrument or cajon percussion instrument or percussion instrument.

Based upon key elements of our design either the increase of or decrease of the quantity of our specified elements could be used to reproduce other percussion instruments with the result of equivalent quality of sound and design.

Any changes in dimension or material for either the exterior or interior elements in the product would produce the same result of the original percussion instrument with a different tonal quality and or amplification of sound to the percussion instrument.

Although specific embodiments of the invention have been disclosed, those having ordinary skill in the art will understand that changes can be made to the specific embodiments without departing from the spirit and scope of the invention. The scope of the invention is not to be restricted, therefore, to the specific examples, and it is intended that the appended claims cover any and all such applications, modifications, and embodiments within the scope of the present invention.

What is claimed is:

1. A box percussion instrument comprising:

a cuboid shaped box with at least six panels; and at least one horizontal rectangular partition and/or at least one vertical rectangular partition to define at least two or more chambers inside the cuboid shaped box, with each chamber of equal or varying volume, wherein a volume of a first chamber of the at least two or more chambers is smaller than volume defined by any other chambers of the at least two or more chambers;

wherein two of the six panels comprise side panels each defining an opening that provides fluid communication between air external to the cuboid shaped box and each of i) a third chamber of the at least two or more chambers, and ii) at least one of the first chamber and a second chamber of the at least two or more chambers.

2. The box percussion instrument of claim 1, wherein at least one of the six panels is thinner than other panels to form a playing surface when percussed.

3. The box percussion instrument of claim 2, further comprising:

a set of snare wires positioned against an inside surface of the at least one of the six panels forming the playing surface.

4. The box percussion instrument of claim 1, wherein one of the six panels comprise a top panel, one of the six panels comprise a bottom panel, and one of the six panels comprise a back panel and third chamber further comprises at least:

a first curved reflective wall with a first side edge, a second side edge, a top edge and a bottom edge, and the top edge in contact with a bottom side of the rectangular horizontal partition and the bottom edge in contact with an interior top side of the bottom panel;

a second curved reflective wall with a first side edge, a second side edge, a top edge and a bottom edge, and the top edge in contact with a bottom side of the rectangular horizontal partition and the bottom edge in contact with the interior top side of the bottom panel; and wherein the first side edge of the first curved reflective wall is substantially parallel to the first edge of the second curved reflective wall, and the second side edge of the first curved reflective wall is substantially parallel to the back panel and the second side edge of the second curved reflective wall is substantially parallel to the back panel.

5. The box percussion instrument of claim 1, wherein one of the six panels comprise a top panel and one of the six panels comprise a back panel and at least one of the first chamber and the second chamber further comprises at least one of:

a curved reflective wall with a first side edge, a second side edge, a top edge and a bottom edge, and the top edge in contact with an interior bottom side of the top panel and the bottom edge in contact with a top side of the rectangular horizontal partition; and wherein the first side edge of the curved reflective wall is substantially parallel to the vertical partition and the second edge is substantially parallel to the back panel.

6. The box percussion instrument of claim 1, wherein one of the six panels comprise a top panel and one of the six panels comprise a back panel and at least one of the first chamber and the second chamber further comprises:

a first curved reflective wall with a first side edge, a second side edge, a top edge and a bottom edge, and the top edge in contact with an interior bottom side of the top panel and the bottom edge in contact with a top side of the rectangular horizontal partition;

wherein the first side edge of the first curved reflective wall is substantially parallel to a first side of the vertical partition and the second edge is substantially parallel to the back panel;

a second curved reflective wall with a first side edge, a second side edge, a top edge and a bottom edge, and the top edge in contact with an interior bottom side of the top panel and the bottom edge in contact with a top side of the rectangular horizontal partition; and wherein the first side edge of the second curved reflective wall is substantially parallel to a second side of the vertical partition and the second edge is substantially parallel to the back panel.

7. The box percussion instrument of claim 1, wherein two of the at least six panels form at least one of a top panel and a side panel which are thinner than other panels of the at least six panels to form a playing surface when percussed.

8. The box percussion instrument of claim 7, further comprising:

a rectangular partition with a top edge, a bottom edge, a first side edge and a second side edge, with the top edge in contact an interior bottom surface of the top panel, the first side edge in contact with a first side panel and the second side edge in contact with a second side panel; and a resonating baffle with a front edge, a back edge, a first side edge and a second side edge, the resonating baffle placed with the front edge in contact with the bottom edge of the rectangular partition and the first side edge in contact with the first side panel and the second side edge in contact with the second side panel, and placed at a height above a top of the opening defined by a front panel and the back edge place at a height lower than the front edge.

9. A box percussion instrument comprising:

a cuboid shaped box with at least six panels defining an interior chamber, with at least six of the panels defining a top panel, a bottom panel, a back panel, a front panel, a first side panel and a second side panel;

the front panel defining an opening that provides fluid communication between air external to the cuboid shaped box and the interior chamber; and a bottom reflective wall with a first side edge in contact with the first side panel, a second side edge in contact with the second side panel, a top edge in contact with the back panel, and a bottom edge in contact with an interior top side of the bottom panel.

10. The box percussion instrument of claim 9, wherein the bottom reflective wall comprises a top curved reflective wall with a first side edge in contact with the first side panel, a second side edge in contact with the second side panel, a top edge in contact with an interior bottom surface of the top panel, and the bottom edge in contact with the back panel.

11. The box percussion instrument of claim 10, further comprising:

a top curved reflective wall with a first side edge in contact with the first side panel, a second side edge in contact with the second side panel, a top edge in contact with an interior bottom surface of the top panel, and the bottom edge in contact with the back panel.

12. The box percussion instrument of claim 10, wherein at least one of the six panels are thinner than other panels to form a playing surface when percussed.

13. The box percussion instrument of claim 11, wherein the interior chamber is split into at least two chambers by a rectangular partition and wherein top panel comprises two regions each region disposed over one of the two chambers respectively.

14. The box percussion instrument of claim 12, wherein the top panel comprises two regions each region having a different thickness and each of the two regions being thinner than other panels to form two separate playing surfaces when percussed.

15. The box percussion instrument of claim 10, further comprising:

a baffle plate with a front edge, a back edge, a first side edge and a second side edge, the baffle plate placed substantially parallel to the bottom panel with the front edge in contact with the front panel and the first side edge in contact with the first side panel and the second side edge in contact with the second side panel, and placed at a height above a top of the opening defined by the front panel.

16. The box percussion instrument of claim 15, wherein at least one of the top panel and/or the side panel are thinner than other panels to form a playing surface when percussed.

17. The box percussion instrument of claim 9, further comprising:

a resonating plate with a front edge, a back edge, a first side edge and a second side edge, the resonating plate placed substantially with the front edge in contact with the front panel and the first side edge in contact with the first side panel and the second side edge in contact with the second side panel, and positioned at a height above a top of the opening defined by the front panel and the back edge positioned at a height lower than the front edge.

* * * * *